United States Patent [19]

Brudi et al.

[11] 3,984,019

[45] Oct. 5, 1976

[54] LIFT TRUCK SIDE LOADING ATTACHMENT PARTICULARLY ADAPTABLE FOR HANDLING ELONGATE LOADS

[75] Inventors: Ronald A. Brudi, Longview; Russell B. Nelson, Castle Rock, both of Wash.

[73] Assignee: Brudi Equipment, Inc., Longview, Wash.

[22] Filed: Oct. 24, 1972

[21] Appl. No.: 300,218

[52] U.S. Cl. ..... 214/620; 214/1 BC; 214/151; 214/DIG. 10

[51] Int. Cl.[2] ..... B66F 9/14

[58] Field of Search ..... 214/DIG. 10, 621, 620, 214/730, 670, 671, 151, 1 BC

[56] References Cited

UNITED STATES PATENTS

| | | | |
|---|---|---|---|
| 1,273,869 | 7/1918 | Joy | 214/DIG. 10 |
| 2,699,879 | 1/1955 | Bertram | 214/730 X |
| 3,106,305 | 10/1963 | Gehring | 214/620 X |
| 3,189,205 | 6/1965 | Quayle | 214/730 X |
| 3,272,365 | 9/1966 | Stevens | 214/671 |
| 3,325,029 | 6/1967 | Rigsby | 214/730 X |
| 3,504,810 | 4/1970 | Walda | 214/671 X |
| 3,572,530 | 3/1971 | Ohntrup et al. | 214/730 |
| 3,672,526 | 6/1972 | Hansen | 214/730 |
| 3,731,822 | 5/1973 | Friesen | 214/1 BC |
| 3,762,588 | 10/1973 | Hansen et al. | 214/730 |

FOREIGN PATENTS OR APPLICATIONS

| | | | |
|---|---|---|---|
| 1,137,927 | 6/1957 | France | 214/671 |
| 1,214,303 | 12/1970 | United Kingdom | 214/730 |

*Primary Examiner*—L. J. Paperner
*Attorney, Agent, or Firm*—Chernoff & Vilhauer

[57] ABSTRACT

A lift truck load handling attachment adaptable particularly for transporting an elongate load longitudinally of said truck and having means for transversely extending the load forks to one side or the other of the truck in order to pick up or deposit the load. The attachment comprises a support member mountable on a conventional lift truck carriage, and includes a forwardly protruding, laterally swinging boom pivotally mounted on the top of the support member. The boom is preferably constructed in the form of an elongate horizontal parallelogram having hinged joints at all four corners. A spaced pair of pivotal joints at the rear of the boom assembly constitute its pivotal connection to the support member, while a cross-head at the front of the boom includes a front pair of pivotal joints. A load handling fork assembly depends from the cross-head with its forks facing transversely to one side of the truck. Manual or power means are provided for permitting the direction of the forks to be reversed toward the opposite side of the truck if desired. In one lateral position of the boom assembly, the side-facing forks are capable of carrying an elongate load longitudinally in a central position in front of the truck. By laterally swinging the boom toward a second position the forks may be extended transversely to the side of the truck in order to pick up or deposit the load. The parallelogram arrangement of the boom insures that the transverse direction of the forks remains constant with respect to the truck despite the lateral swinging of the boom. An alternative embodiment of the invention includes a modified boom assembly wherein a chain and sprocket arrangement is utilized to control the direction of the forks. Motor means may be provided on the attachment support member for selectively driving the chain and sprocket assembly to control fork direction independently of boom position if desired.

6 Claims, 7 Drawing Figures

LIFT TRUCK SIDE LOADING ATTACHMENT PARTICULARLY ADAPTABLE FOR HANDLING ELONGATE LOADS

BACKGROUND OF THE INVENTION

This invention relates to improvements in lift truck load handling attachments of the type whereby a load may be carried in a central position and extended transversely to the side of the truck when desired. More specifically, the attachment is of a type particularly adaptable for transporting elongate loads longitudinally through relatively narrow warehouse aisles, wherein the load handling forks may be extended sideways from the longitudinal center line of the truck to pick up or deposit the load.

In side loading or narrow-aisle attachments of the type known to the art and shown for example in Stanton, U.S. Pat. No. 3,599,818; Dixon, U.S. Pat. No. 3,390,798; and Ulinski, U.S. Pat. No. 2,709,017; a supporting boom is rigidly fixed to the lift truck carriage with a laterally rotatable fork assembly depending from its forward end. Because the boom is fixed to the carriage and therefore cannot swing laterally from side to side, each of the aforementioned devices must include a pantographic or similar type power linkage adjacent the fork assembly to extend the forks laterally. The requirement for such lateral extension devices and their respective motors makes the attachment relatively complicated and expensive and, what is more significant, adds considerable weight to the front of the boom assembly thereby detracting substantially from the load-lifting capability of the truck. The resultant reduction in truck stability limits both the weight and length of a given load which may safely be transported and elevated in a longitudinal position with respect to the truck.

Another general type of side loading attachment is illustrated in Ohntrup et al, U.S. Pat. No. 3,572,530 and Hansen, U.S. Pat. No. 3,672,526. These patents each feature a fork assembly carried by the outer end of a laterally swinging member mounted on the lift truck carriage, the lateral movement of such member providing at least a limited degree of transverse fork extension. However in neither case does the fork assembly depend from the swinging member in such a way that, with the forks situated transversely in the center of the truck, the load may be carried beneath the swinging member. With reference to the Ohntrup et al patent, this deficiency makes it impossible for the attachment to carry loads longitudinally in the center position without the added provision of a side shifting assembly and its related motor, which in turn add to the expense and weight of the attachment. In the case of Hansen, wherein the fork assembly and load are situated above the laterally swinging member, an auxiliary set of lifting cylinders must be provided at the front of the attachment in order to lift the load above the swinging member to thereby permit proper load positioning. This requirement likewise increases the weight and complexity of the attachment.

A third type of device is that depicted in Stevens, U.S. Pat. No. 3,272,365. This device, which is not an attachment but rather requires basic modification of the lift truck, utilizes a laterally swinging boom having so much weight forwardly of the center of gravity of the truck that an auxiliary caster at the base of the fork assembly is required to enable the truck to handle sufficient loads. Obviously the requirement for such an auxiliary caster limits severly the maneuverability of the truck and makes it quite difficult for the truck to negotiate ramps or other uneven surfaces.

Accordingly, a great need exists in the lift truck industry for a relatively inexpensive and uncomplicated load handling attachment having side loading and side extending capability for use in narrow aisle situations, such attachment having a minimum of heavy mechanical components and a minimum of weight at its forward end, thereby maximizing the load-carrying capability of the truck and enabling loads of substantial length and weight to be handled, particularly in a longitudinal position with respect to the truck.

SUMMARY OF THE PRESENT INVENTION

The present invention is directed to a side loading attachment for lift trucks of the general type described in which transverse fork extension and fork direction are controlled by a relatively simple mechanism having a minimum of weight located adjacent the forward end of the attachment. The attachment comprises a laterally swinging boom and means for mounting the rear end of the boom on the lift truck carriage. At the front of the boom is a transversely facing load handling assembly preferably comprising a pair of forks depending a sufficient distance below the boom that a normal load may be carried directly beneath the boom in horizontally overlapping fashion without interference between the boom and the load. The boom preferably is constructed in the form of an elongate hinged parallelogram with the fork assembly depending from a cross-head forming a shorter side of the parallelogram at the front of the boom. Manual or power adjustment means on the cross-head permit the transverse direction of the forks to be reversed if desired. A hydraulic cylinder is provided adjacent the lift truck carriage for laterally slewing the boom to provide transverse extension of the fork assembly, and the parallelogram arrangement insures that the fork direction remains constant with respect to the lift truck during such slewing. An alternative embodiment of the invention utilizes a chain and sprocket assembly, which is merely a different form of parallelogram linkage, to regulate fork direction. in such case motor means may be provided adjacent the lift truck carriage for selectively rotating the position of the rearward sprocket of the assembly if desired, in order to change fork direction irrespective of boom position. Means are also provided for adjusting the relative maximum transverse swing of the boom, and thus the maximum transverse extension of the fork assembly, to one side or the other of the lift truck.

The provision of a laterally swinging boom mountable on a conventional lift truck mast, coupled with a depending load handling assembly of the type described which permits the load to be carried in a central position directly beneath the boom, is extremely advantageous in that it permits the transporting of loads in a central position supported by transversely facing forks without requiring the presence of side shifting equipment or auxiliary load lifting equipment which would add to the weight and expense of the attachment. Moreover it permits transverse fork extension without the need for pantographic or other independent extending mechanisms. In addition, the parallelogram arrangement retains the load handling assembly in a constant preselected direction with respect to the truck regardless of the slewing motion of the boom without requiring heavy or complicated control mechanisms in order to do so. If desired, fork direction may be changed by various alternative means, including manual manipulation or by a power mechanism located at the front or rear of the boom. In all respects the structural weight at the forward end of the attachment, where the lever arm opposing the counterbalancing capability of the truck is the greatest, is kept to a minimum.

It is accordingly a principal objective of the present invention to provide a relatively inexpensive and uncomplicated load handling attachment having side loading and side extending capability for use in narrow aisle situations and having a minimum of heavy mechanical components and a minimum of weight concentrated adjacent its forward end, thereby maximizing the load carrying capability of the truck and enabling loads of substantial length and weight to be handled, particularly in a longitudinal position with respect to the truck.

It is a principal feature of the present invention that a laterally swinging boom mountable on a conventional lift truck mast is provided with a load handling assembly adjacent its forward end depending a sufficient distance from the boom that a normal load may be positioned directly beneath the boom without interference therewith. It is a further principal feature of the present invention that the boom utilizes a parallelogram principle for retaining the load handling assembly in a constant horizontal direction with respect to the lift truck regardless of the lateral swing of the boom member.

The foregoing and other objectives, features and advantages of the present invention will be more readily understood upon consideration of the following detailed description of the invention taken in conjunction with the accompanying drawings.

DESCRIPTION OF THE PREFERRED EMBODIMENT

Figure 2:
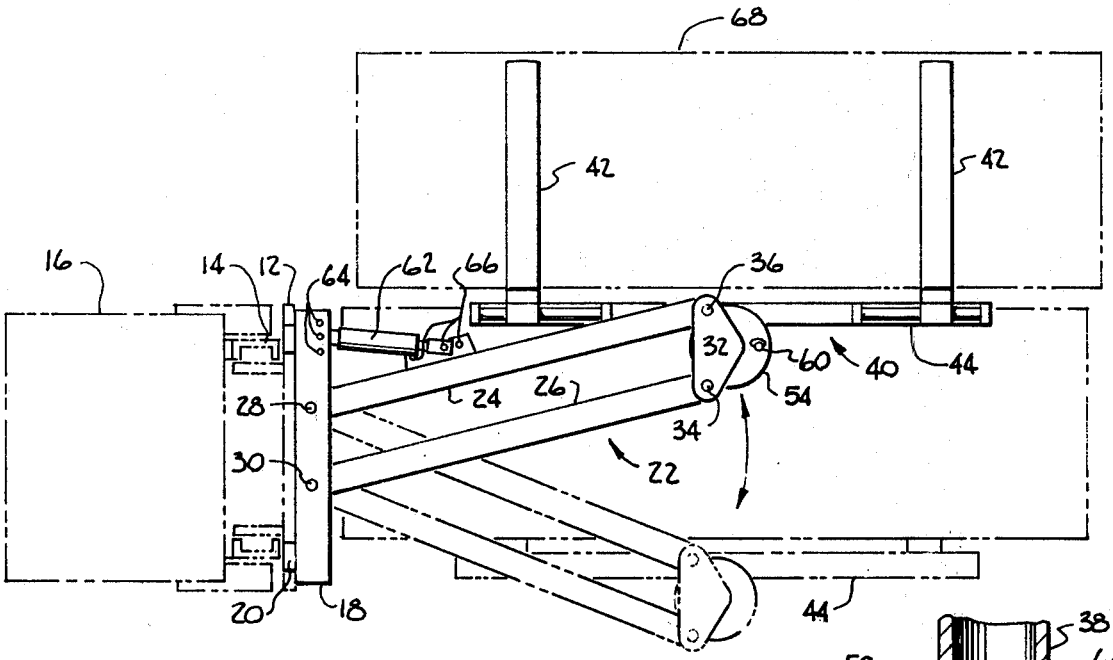
FIG. 2 is a top view of the attachment, shown with its load handling assembly extended to one side of the truck for picking up or depositing a load and, in phantom, showing a retracted position of the load handling assembly for transporting an elongate load longitudinally of the truck in a central position.
Figure 1:
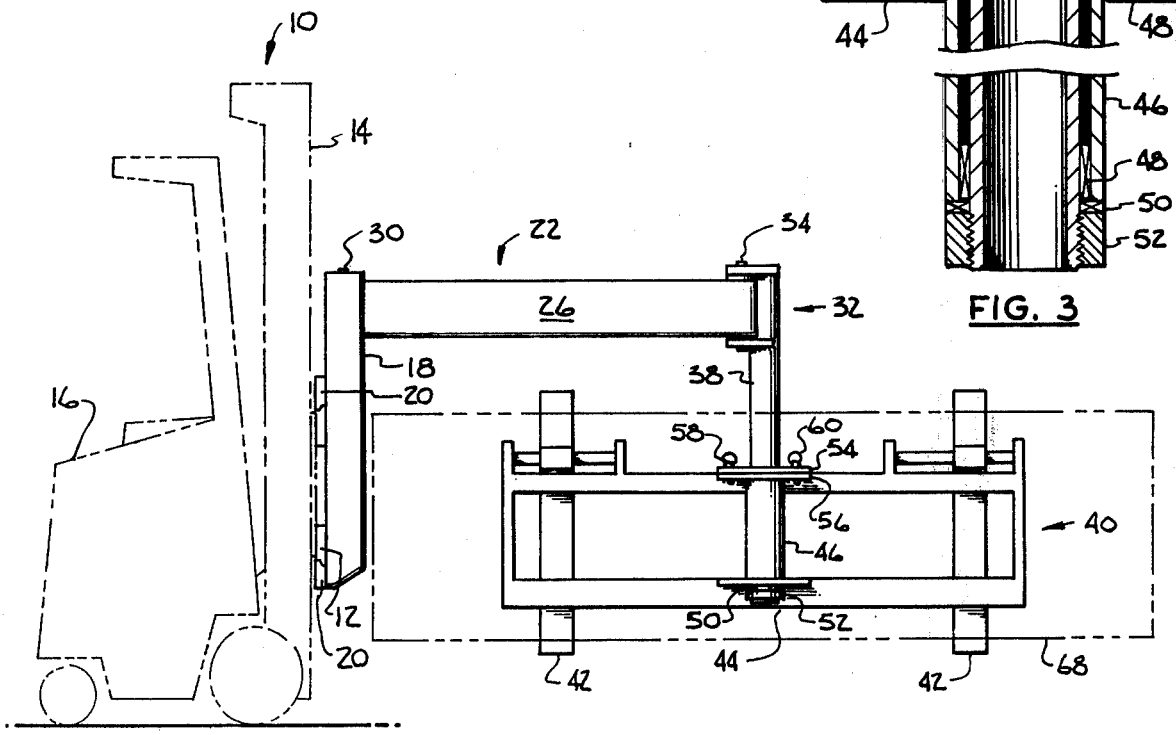
FIG. 1 is a side elevation view of an illustrative embodiment of the attachment, shown mounted on the mast of a conventional lift truck.

The side loading attachment of the present invention may be mounted on a conventional load lifting mast 10 of a lift truck 16, such mast normally comprising an upright portion 14 and a carriage 12. The attachment comprises a support member 18 preferably equipped with hooks 20 which are adapted for quick mounting and demounting on the carriage 12. A boom, designated generally as 22, is pivotally attached at the top of the support member 18 so as to be capable of slewing laterally in a horizontal plane. In the preferred embodiment of the invention, depicted in FIGS. 1 and 2, the boom 22 comprises a parallelogram linkage having a pair of elongate arms 24 and 26, each with its respective rear end pivotally mounted to the support member 18 at laterally spaced pivot points 28 and 30 respectively. A cross-head assembly 32 joins the forward ends of the elongate arms 24 and 26 at laterally spaced pivot points 34 and 36 respectively, thereby forming a four-sided parallelogram linkage 28, 30, 34, 36 having opposite sides of equal length. Each of the aforesaid pivot points 28, 30, 34 and 36 preferably includes a vertically elongate shaft about which one end of the respective arms 24 and 26 is journaled, so as to provide a vertically rigid structure with joints capable of resisting vertical and torsional moments.

Depending from the cross-head 32, and supported by a post 38 rigidly affixed to the cross-head, is a load handling assembly 40, normally comprising a pair of forks 32 hanging from an apron structure 44. Alternatively, the assembly 40 might conceivably comprise load handling equipment other than forks, for example clamps, vacuum attachments etc.

Figure 3:
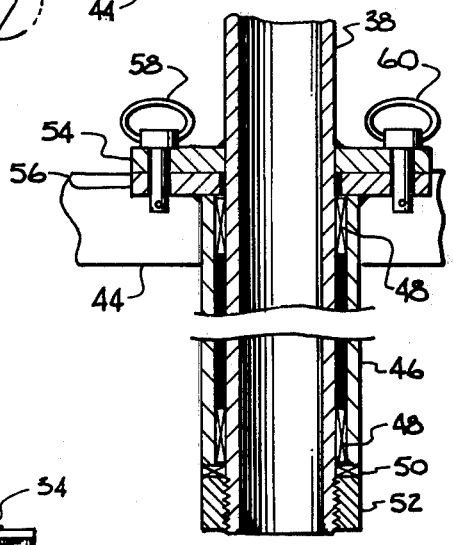
FIG. 3 is an extended, sectional detail view of a manual adjustment means by which the horizontal direction of the load handling assembly with respect to the lift truck may be changed if desired.

As best seen in FIG. 3, the apron 44 includes a sleeve portion 46 which is journaled to the post 38 by means of bushings 48 so that the sleeve 46 and thus the entire load handling assembly 40 may rotate about the post 38. The assembly 40 derives its vertical support from the boom 22 by virtue of the abutment of the lower end of sleeve 46, through thrust bushing 50, with a cap 52 threaded and staked onto the lower end of post 38. A peripheral flange 56 welded to the top of sleeve 46 abuts a mating flange 54 welded to the post 38. Each flange carries a pair of diametrically opposed aligning apertures through which a pair of retainer pins 58 and 60 respectively may be inserted to prevent rotation of the load handling assembly 40 with respect to the post 38, thereby fixing the load handling assembly 40 to the cross-head 32. Since the attachment is intended for side loading purposes, the apertures in the respective flanges are positioned such that, when the apertures are aligned, the forks 42 face transversely at right angles to the direction of travel of the lift truck 16. Since the apertures are diametrically opposed, the forks may be selectively manually positioned either for right or left hand use.

Lateral slewing of the boom 22 is preferably controlled by a double acting hydraulic cylinder 62 extending between one of several alternative connecting points 64 on the support member 18 and one of the connecting points 66 on the boom. It is immaterial whether the cylinder 62 is located on the right or the left side of the boom, but its length of stroke and respective connection points should be such as to permit it to slew the boom from a fully retracted position, as shown in phantom in FIG. 2, to a laterally extended position wherein the load handling assembly 40 extends beyond the side of the truck for purposes of picking up or depositing a load. Inasmuch as the load handling assembly 40 can be rotated 180°, as described in the previous paragraph, so as to face either side of the truck, the cylinder 62 should be able to position the boom in the aforementioned retracted and extended positions with respect to both sides of the truck. Because additional extension of the load handling assembly 40 to a particular side of the truck may be desirable under certain conditions, a plurality of rear connecting points 64 and front connecting points 66 are provided so that the maximum geometric limits of the boom's retracted and extended positions may be adjusted in favor of one side of the truck or the other if desired. Instead of a plurality of connecting points such as 64, 66, an alternative adjustable structure might comprise a single front and rear connecting point respectively mounted on a transversely positioned screw so that such connecting point could be laterally moved with infinite variation along the screw to permit fine adjustment of the aforementioned boom slewing limits.

In operation, with the forks 42 adjusted so as to face to the left of the truck 16 and with the retainer pins 58 and 60 inserted in their respective apertures as shown in FIG. 3, the boom 22 may be swung to the left by the retraction of cylinder 62 so as to pick up a load 68. Thereafter cylinder 62 may be extended to swing the boom and forks to their retracted position shown in phantom in FIG. 2. During such lateral slewing of the boom 22, the cross-head 32 and its associated post 38, which couple the load handling assembly 40 to the boom, do not change their horizontal direction with respect to the truck 16 due to the control exerted by the parallelogram linkage of the boom. Consequently the load handling assembly 40, which is fixed to the post 38 by means of pins 58 and 60, is retained in a constant horizontal direction with respect to the truck 16 despite the slewing motion of the boom. However the assembly 40 changes direction with respect to the slewing boom itself due to the parallelogram linkage. Thus, when the boom is in its fully retracted position shown in phantom in FIG. 2, at least a portion of the load handling assembly and a portion of the load 68 will have moved to a position directly beneath the boom 22.

In order to permit the aforementioned retracting motion without interference between the boom 22 and the top of either the load handling assembly 40 or the load 68, at least certain components of the load handling assembly (e.g. the tops of the rearward fork 42 and rearward portion of the apron 44) must depend a sufficient distance below the boom 22 that such interference is avoided. This in turn permits maximum retraction of the load to bring is as much as possible within the width dimension of the truck and thereby minimize any portion left protruding beyond the side of the truck, thereby permitting transportation of the load in relatively narrow aisles.

Upon reaching its destination, the load 68 may be deposited by once more retracting cylinder 62, thereby extending the boom 22 and its associated load handling assembly 40 beyond the side of the truck until the load 68 is properly positioned. After the load has been deposited the boom is once more retracted to permit the empty truck to travel to its next destination. It will be appreciated that, by pulling the retainer pins 58 and 60 and manually horizontally rotating the load handling assembly 180°, the attachment may operate to the right side of the truck in the same manner as has been described for the left side.

Figure 4:
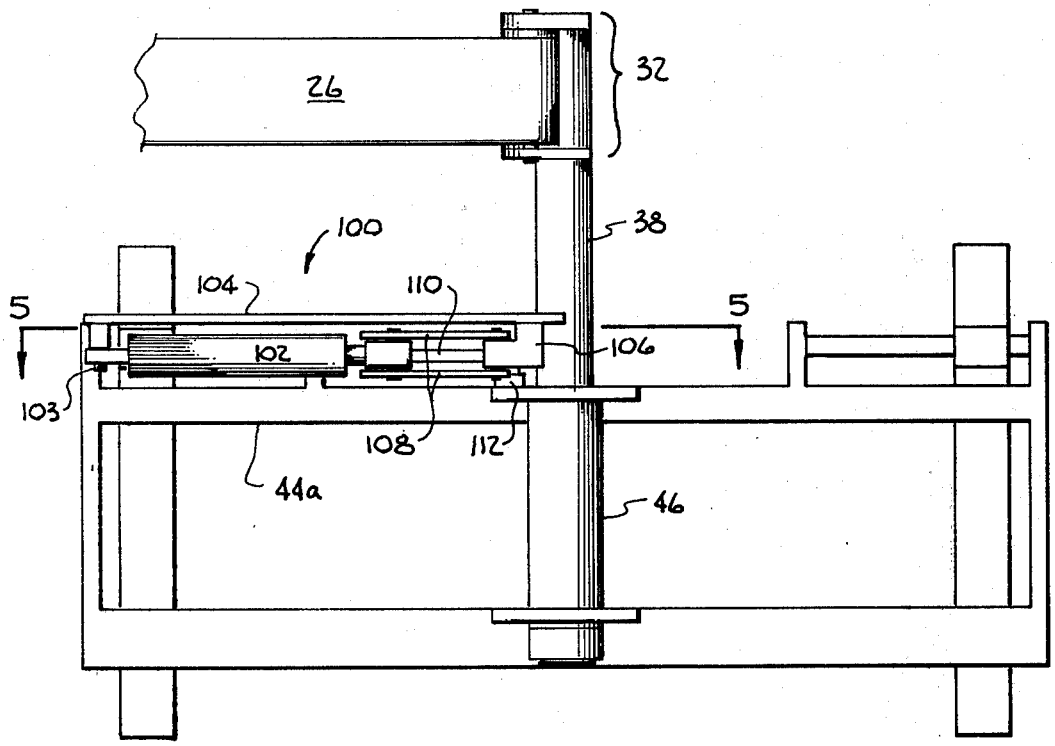
FIG. 4 is a partial side view of a modified version of the attachment, showing a hydraulic power linkage for changing the horizontal direction of the load handling assembly with respect to the lift truck.
Figure 5:
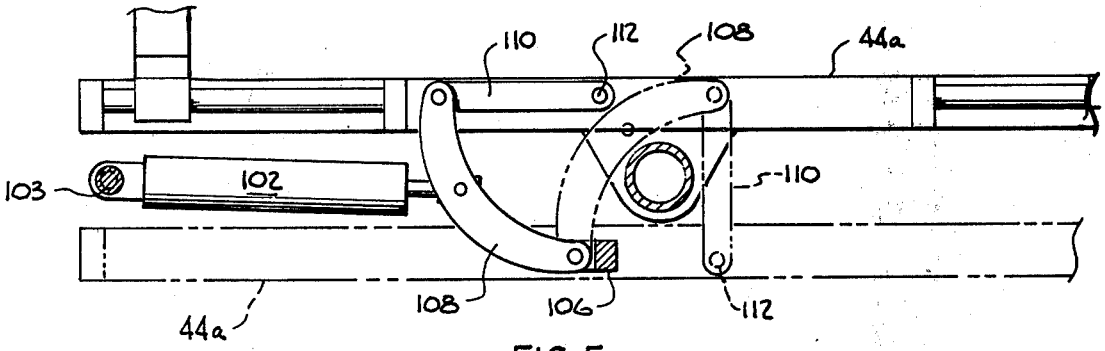
FIG. 5 is a top view of the power linkage of FIG. 4, shown with the load handling assembly facing in opposite directions.

FIGS. 4 and 5 illustrate an optional hydraulic power adjustment mechanism by which the load handling assembly 40 may be mechanically rotated 180° for right or left hand operation rather than requiring manual rotation and the use of retainer pins 58 and 60 as previously described. The optional power adjustment mechanism, designated generally as 100 in FIG. 4, preferably comprises a double-acting hydraulic cylinder 102 having one end pivotally mounted at 103 to a laterally projecting arm 104 welded to the post 38 which depends from cross-head 32. An arcuate lever member 108 is pivotally mounted at one end to a lug 106 fixed to the underside of arm 104. At the other end of the lever member 108 one end of a link 110 is pivotally connected, the other end of the link 110 being pivotally attached at 112 to the top of the apron 44*a*. Approximately midway between the ends of the lever member 108 is attached the other end of the hydraulic cylinder 102. Upon retraction of the cylinder 102, the lever member 108 is rotated rearwardly about lug 106 so that, acting through link 110, it draws the apron 44*a* into a left-side facing position as shown in solid lines in FIG. 5. Alternatively, extension of cylinder 102 rotates lever member 108 forwardly about lug 106 and thus rotates apron 44*a* into a right-side facing position as shown in phantom in FIG. 5. As will be appreciated by those skilled in the art, the actuation of cylinder 102 to extend or retract and thereby change the direction of the load handling assembly can be controlled from the lift truck operator's station by means of a hydraulic valve regulating the flow of pressurized fluid to the cylinder through conduits of conventional design (not shown). As an alternative to the linkage 108, 110, the hydraulic cylinder 102 could conceivably be coupled to the apron 44*a* through a rack and pinon assembly to achieve the desired 180° rotation. As a further variation, a hydraulic or electric motor might be mounted on the post 38 in place of the cylinder 102 and coupled with the apron 44*a* through appropriate gearing to achieve the desired rotation.

Figure 7:
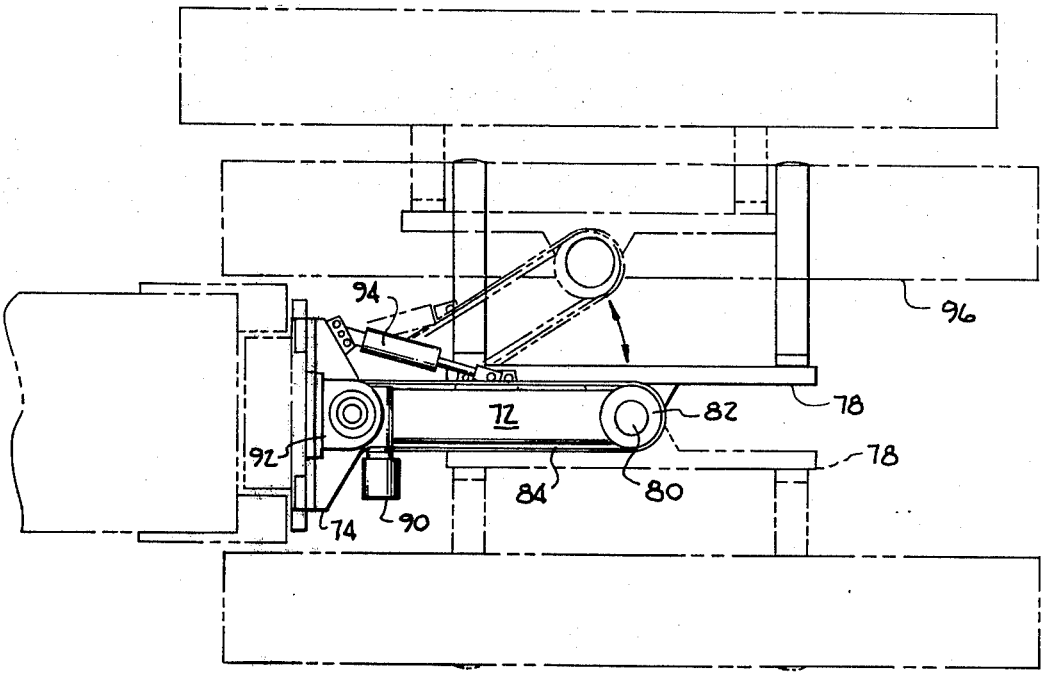
FIG. 7 is a top view of the embodiment of FIG. 6, showing the attachment situated in various operating positions.
Figure 6:
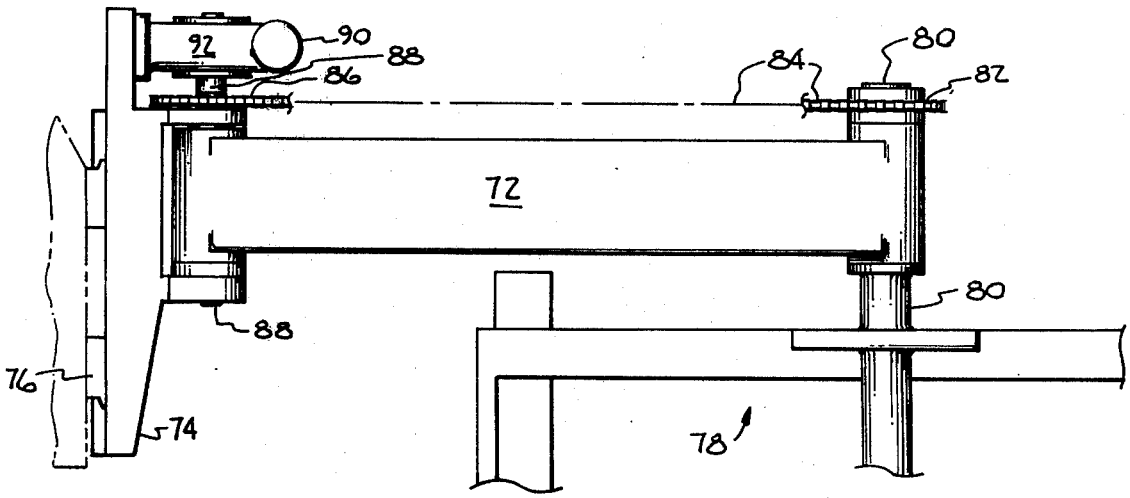
FIG. 6 is a partial side view of an alternative embodiment of the invention showing a chain and sprocket assembly for regulating the direction of the load handling assembly.

FIGS. 6 and 7 illustrate an alternative embodiment of the invention wherein the attachment comprises a boom 72 pivotally connected at its rear end to a support member 74, which is in turn mounted on a lift truck carriage 76. The load handling assembly 78 is pivotally mounted to the front of the boom 72 and depends therefrom in a manner similar to the load assembly 40 of the previous embodiment. However the post 80 which supports the load handling assembly 78, rather than being fixed to a cross-head as in the previous embodiments, is journaled to the boom 72 for rotation about a vertical axis. Affixed to the top of the post 80 is a sprocket 82 coupled by means of an endless chain 84 with a second sprocket 86. The sprocket 86 is affixed to a shaft 88 by which the rear end of boom 72 is pivotally connected to the support member 74. The shaft 88 is rotatably journaled both with respect to the boom 72 and the support member 74 such that the shaft and sprocket 86 may be rotated by actuation of a hydraulic motor 90 mounted on support member 74, such motor being coupled with the shaft 88 through a worm drive gear box 92. Other types of power means might perform this function just as well, for example a hydraulic cylinder coupled with the shaft 88 through a rack and pinon assembly. In any case the driving mechanism should be such that, if it is not desired to rotate the shaft 88 and sprocket 86, the shaft and sprocket will be automatically locked in a particular rotational position with respect to the support member 74.

Lateral slewing of the boom 72 is accomplished by means of a hydraulic cylinder 94 in a manner similar to the previous embodiments. However, the boom 72 incorporates a different type of parallelogram linkage for controlling the direction of the load handling assembly 78. In this case the parallelogram linkage comprises a combination of the single boom member 72 and the chain and sprocket assembly 82, 84, 92. Thus, with the motor 90 not being actuated and with the rear sprocket 86 therefore held in a fixed position with respect to support member 74, the boom 72 may be slewed laterally in either direction and the chain and sprocket assembly will automatically retain the load handling assembly 78 in a constant horizontal direction with respect to the lift truck. However by actuating motor 90 and thereby rotating sprocket 86, any desired direction of the load handling assembly 78 may be selected through the chain and sprocket assembly without the need for manual adjustment, thereby performing a power function comparable to that of the previously described adjustment cylinder 102.

With the alternative embodiment of FIGS. 6 and 7, the truck operator may handle loads with equal facility to either side of the truck as illustrated by the various positions of the attachment depicted in FIG. 7. The attachment may be operated in the same manner as the previous embodiment or, alternatively, longer loads such as 96 comprising such materials as lumber or bundled pipe may be handled. Of course if the load is too long to be transported in a fully retracted position, as is the case illustrated in FIG. 7, it may be carried in close proximity to the side of the truck which will of course require wider aisles. However with comparatively little structural weight being located at the front of the boom, the boom therefore may be relatively long, depending upon the capacity of the particular lift truck, thereby maximizing the length of load which can be transported longitudinally in a fully retracted central position.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A side loading attachment for a lift truck having a load lifting upright and carriage, said attachment comprising:

a. a boom;

b. means pivotally mounting the rear end of said boom to said carriage for permitting said boom to slew laterally in a horizontal plane about a vertical pivot axis fixed with respect to said carriage;

c. a load handling assembly pivotally depending from the forward end of said boom so as to permit said load handling assembly to rotate in a horizontal plane with respect to said boom in a position directly beneath said boom;

d. said boom including mechanical linkage means for automatically retaining the horizontal direction of said load handling assembly with respect to said lift truck constant irrespective of the lateral slewing position of said boom; and e. selectively actuated power means mounted adjacent the front end of said boom for controllably varying said horizontal direction of said load handling assembly with respect to said lift truck.

2. A side loading attachment for a lift truck having a load lifting mast, said attachment comprising:

a. a support member adapted to be mounted on said mast;

b. an elongate boom pivotally attached adjacent its rear end to said support member so as to permit said boom to slew laterally in a horizontal plane;

c. a load handling assembly;

d. coupling means mounted adjacent the forward end of said boom for suspending and vertically supporting said load handling assembly from said boom, said coupling means including means for permitting relative horizontal directional movement between said load handling assembly and said boom;

e. said coupling means including means for suspending at least a portion of said load handling assembly below said boom in such a way that said portion may be moved horizontally into a position directly beneath said boom without interference therewith during said relative movement between said load handling assembly and said boom;

f. means for automatically retaining the horizontal direction of said load handling assembly constant with respect to said lift truck during the slewing of said boom, including means for automatically causing said portion of said load handling assembly to move relative to said boom into said position beneath said boom in response to said slewing; and g. controllable power adjustment means for selectively changing said constant direction of said load handling assembly with respect to said lift truck.

3. The attachment of claim 2 wherein said controllable power adjustment means comprises selectively actuated power means interacting between said load handling assembly and said coupling means for rotating said assembly with respect to said coupling means.

4. The attachment of claim 3 wherein said power means comprises a double-acting hydraulic cylinder interacting between said load handling assembly and said coupling means for rotating said assembly by the extension and retraction of said cylinder.

5. A side loading attachment for a lift truck having a load lifting mast, said attachment comprising:

a. a support member adapted to be mounted on said mast;

b. an elongate hinged parallelogram structure protruding forwardly from said support member, each elongate arm of said parallelogram structure being pivotally connected by a rear joint to one of a pair of spaced points on said support member for lateral slewing in a horizontal plane, said rear pivotal joints each including means for resisting vertical moments imposed by said arms;

c. said parallelogram structure including a cross-head joining the front ends of said pair of elongate arms together, the respective junctions of said pair of arms with said cross-head comprising a pair of laterally spaced pivotal joints;

d. load handling means attached to said cross-head adapted to face transversely with respect to said lift truck for engaging a load in response to the lateral slewing of said parallelogram structure; and e. adjustment means for permitting the horizontal direction of said load handling assembly with respect to said cross-head to be altered, said adjustment means including power means mounted to said cross-head for selectively changing the horizontal direction of said load handling assembly with respect to said cross-head.

6. The attachment of claim 5 wherein said power means comprises a double-acting hydraulic cylinder coupled between said load handling assembly and said cross-head for selectively changing said horizontal direction of said load handling assembly with respect to said cross-head by the extension and retraction of said cylinder.

* * * * *

UNITED STATES PATENT AND TRADEMARK OFFICE

CERTIFICATE OF CORRECTION

PATENT NO. : 3,984,019

DATED : October 5, 1976

INVENTOR(S) : Ronald A. Brudi and Russell B. Nelson

It is certified that error appears in the above-identified patent and that said Letters Patent are hereby corrected as shown below:

Col. 5, Line 54 Change "is" to --it--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*